US005263894A

United States Patent [19]

Hirakawa et al.

[11] Patent Number: 5,263,894

[45] Date of Patent: Nov. 23, 1993

[54] METHODS AND APPARATUS FOR VENTILATING CARRIAGES

[75] Inventors: Haruo Hirakawa, Kudamatsu; Shinichiroo Ishikawa, Tokuyama; Hiroshi Higaki, Kudamatsu; Atsushi Ikio, Tokuyama; Masakazu Matsumoto, Kudamatsu, all of Japan

[73] Assignee: Hitachi, Ltd., Tokyo, Japan.

[21] Appl. No.: 832,391

[22] Filed: Feb. 7, 1992

[30] Foreign Application Priority Data

Feb. 8, 1991 [JP] Japan ..... 3-17469

[51] Int. Cl.[5] ..... B61D 27/00

[52] U.S. Cl. ..... 454/105; 454/194

[58] Field of Search ..... 454/70, 75, 94, 103, 454/105, 107, 112, 194

[56] References Cited

U.S. PATENT DOCUMENTS 3,363,540 1/1968 Mason ..... 454/194
3,459,114 8/1969 Baclini ..... 454/194
3,561,346 2/1971 Stephenson et al. ..... 454/194
5,137,490 8/1992 Ishikawa et al. ..... 454/75

FOREIGN PATENT DOCUMENTS 0253979 1/1988 European Pat. Off. .
0326044 8/1989 European Pat. Off. .

*Primary Examiner*—Harold Joyce
*Attorney, Agent, or Firm*—Antonelli, Terry, Stout & Kraus

[57] ABSTRACT

A ventilation control device for a high-speed train carriage is operable in conjunction with a ventilating blower. A deflectable spring flap is mounted to extend across the ventilation duct in the air flow path. When deflection of the flap reaches a threshold level corresponding to possible passenger discomfort, the flap operates a limit switch positioned behind it. This activates a driving solenoid to close a shutter which shuts off the flow through the duct. A timer holds the shutter closed for a predetermined period, after which it is re-opened. Use of a microprocessor-controlled continuous sensor and damper can thereby be avoided, while cutting out very large pressure fluctuations.

20 Claims, 6 Drawing Sheets

METHODS AND APPARATUS FOR VENTILATING CARRIAGES

FIELD OF THE INVENTION

This invention relates to methods and apparatus for ventilating carriages, and in particular embodiments to ventilating the carriages of high-speed trains.

BACKGROUND OF THE INVENTION

Conventionally, train carriages are ventilated by intake and exhaust ducts with respective electric blowers by which air is collected from outside a carriage passed through the interior space of the carriage, and exhausted to the exterior. During operation the exterior air pressure varies substantially. In particular it fluctuates when two trains pass one another, when a train enters or leaves a tunnel, and most particularly when two trains pass one another in a tunnel. The magnitude of the fluctuation varies approximately in proportion to the square of the train velocity, assuming closely-matched sectional areas for the trains and the tunnel.

DESCRIPTION OF THE PRIOR ART

Measures have been proposed which attempts to reduce sudden ventilation air flow changes arising from sudden pressure changes.

JP-A-227850/1987 describes a sensor which continuously monitors pressure inside the carriage. A microprocessor connected to the sensor controls the continuous adjustment of throttle valves provided in the intake and exhaust ducts.

Our own earlier EP-A-315108 describes an air flow regulator including two flexible plates projecting across the duct from fixing points on opposite sides thereof. Bending of the plates caused by increased pressure difference reduces the flow gap between the plates and hence the flow rate. This has the advantage of not requiring any control system. EP-A-315108 also describes a controlled system with a pressure sensor on the outside of the carriage near the air intake. The sensor is connected to a control processor which, when either the rate of pressure change or the degree of pressure change exceeds a predetermined respective limit, controls the movement of an adjustable damper in the duct and/or the power exerted by the blowers in order to avoid passenger discomfort.

SUMMARY OF THE INVENTION

In recent years, faster and faster trains have been developed. Speeds well in excess of 250 km/h are routinely achieved by trains on conventional tracks. Trains running faster than 300 km/h are being introduced, and speeds of over 400 km/h are envisaged for the new generation of linear magnetic drive trains running on special magnetic tracks. In these circumstances there are more serious problems to overcome as regards ventilation, in view of the pressure fluctuations mentioned above. Specifically, the pressure is likely to vary beyond the operating capacity of any reasonable blower used in a ventilation system. That is, the pressure may rise so high that air is forced back in through the ventilation exhaust duct, or falls so low that air is sucked out through the intake duct. In either case a sudden change of pressure occurs inside the car, giving the passengers the well-known and unpleasant "blocked ear" sensation.

Prior art systems using continuous pressure monitoring with a sensor and control processor are complicated. Furthermore, they are not satisfactory when extreme pressure variations occur.

The system using flexible plates is simple, but substantial clearances are needed for free movement of the plates and so the device gives insufficient air-tightness to deal with large pressure differences.

Objects addressed herein include the provision of novel ventilation devices for carriages, carriages with novel ventilation systems, and novel methods of ventilating carriages. Preferably, it is sought to provide such devices, carriages and methods which are adaptable to the extreme demands imposed by very high-speed trains.

In a first aspect, the invention provides a ventilating device for the interior of a high-speed carriage, comprising a shutter for closing a ventilating duct communicating between the interior and the exterior of the carriage, and having a sensing device having a movable element subject to air flow between the interior and exterior of the carriage, and means actuated by the sensing device only after a predetermined degree of movement of the movable element thereof, to cause the shutter to close the ventilating duct.

The sensing device, shutter and shutter closing means may be provided for both the intake duct and the exhaust duct of a carriage.

By using as a sensor, a movable element which is subject to the actual air flow between the interior and exterior, the sensing device can be designed and adjusted on an empirical basis to obtain satisfactory results. The shutter closing means is not actuated by the sensing device until the predetermined movement has occurred, so the actuation means can be very simple e.g. a mechanical limit switch. This may be actuated by being contacted by the movable element itself a it reaches the predetermined threshold level.

The movable element is preferably a flap which extends across the duct. Usually it is moved by the air flow against a restoring force, preferably a spring restoring force. It may itself form a leaf spring, and/or be moved against one or more separate restoring springs. In the preferred form, it is mounted for a swinging movement in the duct i.e. with one fixed end.

In a second aspect, the invention provides a ventilating device for a train carriage, comprising a duct and a fan for blowing air through the duct;

a shutter movable to close the duct, and means for driving the movable shutter;

a movable flap extending across the duct so as to be moved against a restoring force under the influence of air blowing through the duct, in which the movable flap mechanically actuates the shutter-driving means at a predetermined degree of movement of said flap.

Such a device may be mounted at an exterior portion of a train carriage e.g. underneath the carriage.

In a third aspect, the invention provides a train carriage having a ventilator system comprising an intake blower for blowing air from the exterior to the interior of the carriage through an intake duct, and an exhaust blower for blowing air from the interior to the exterior of the carriage through an exhaust duct;

wherein air flow sensing devices are provided in the intake and exhaust ducts, including means for determining when air flow therein reaches a predetermined threshold value, and shutters are operatively connected to the sensing devices and operate, so as to close off air flow through the ducts, only when the air flow threshold value is reached.

Usually a similar ventilation system would be provided for each carriage of a train comprising plural carriages.

Because the ventilating control device described above does not necessarily require any microprocessor monitoring system, the device can be operated using only AC power, because that is generally all that the shutters and sensing devices need.

For safety and convenience, it is also desired that means for de-activating the shutter-closing drive in the event of a defect thereof are also connected to cut off the respective blower at the same time. This can avoid damage and make it easier to locate faults.

In a fourth aspect, the invention provides a method of ventilating a high-speed carriage in which an intake blower blows air from the exterior to the interior of the carriage through an intake duct, and an exhaust blower blows air from the interior to the exterior of the carriage through an exhaust duct, including the steps of contacting air flow in the exhaust and intake ducts against respective movable sensing elements;

shutting off a respective one of said ducts when the degree of movement of the movable element therein reaches a predetermined value;

holding said duct in the shut off condition for a pre-set time period, and then re-opening said duct to allow resumption of air flow.

This methodology obviates the continuous sensing which was required in the prior art methods, and thereby obviates the complicated and sensitive apparatus required for that sensing. Even when a prolonged period of pressure imbalance occurs, the air flow is "sampled" by the sensing element as each pre-set time period expires; if the air flow is still too great then the duct is immediately closed again.

The method may involve shutting both the intake and exhaust ducts when the rate through either reaches the critical value.

Embodiments of the invention are now described by way of example, with reference to the accompanying drawings in which FIG. 1 is a schematic side view of a train car indicating a ventilation system;

DETAILED DESCRIPTION OF THE INVENTION

Figure 1:
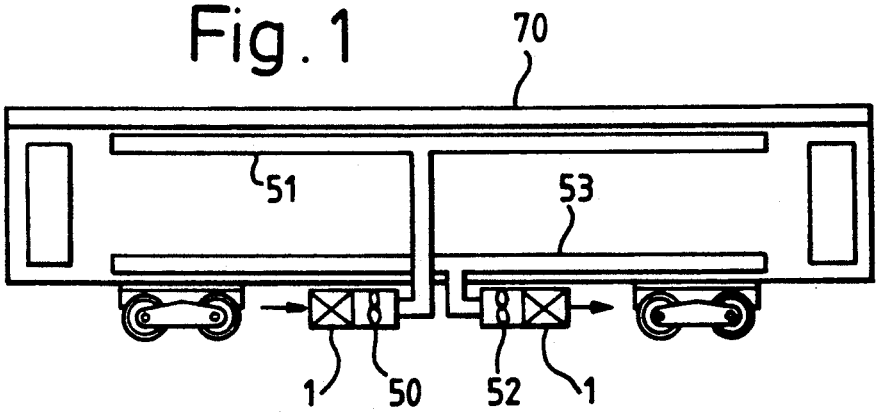
Figure 2:
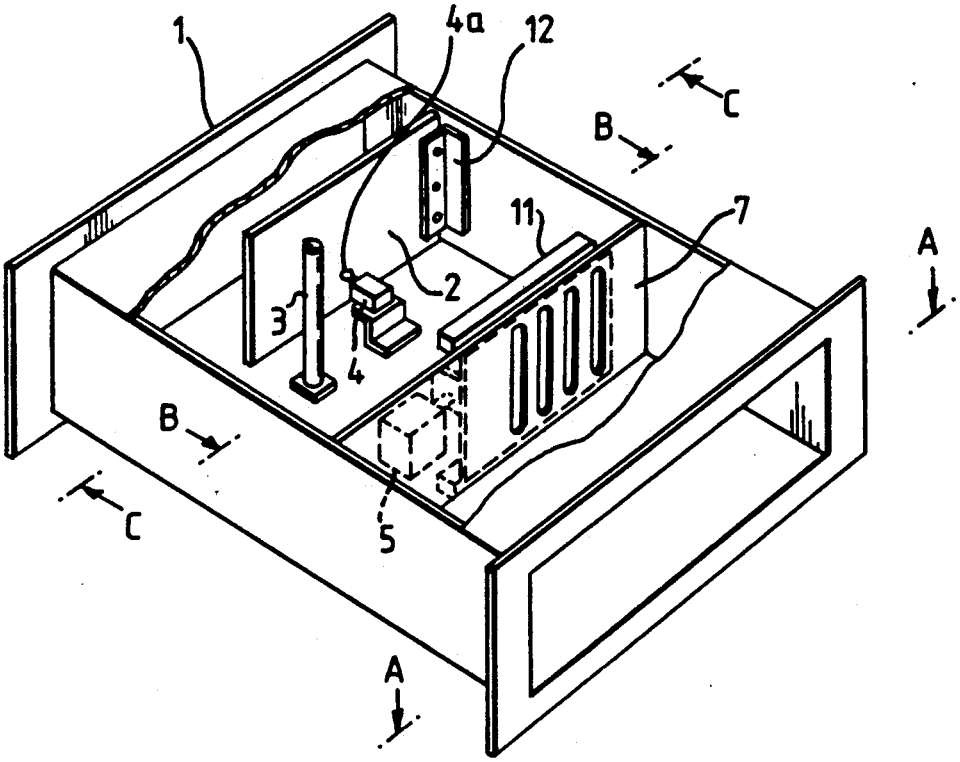
FIG. 2 is a broken away perspective view of a first embodiment of a ventilating device.

A railway carriage 70 as illustrated in FIG. 1 has a ventilation system consisting basically of an electric-powered intake blower 50 taking air in from underneath the car and leading into an intake duct 51 which typically extends along the ceiling of the car. The duct along the ceiling has a plurality of vents in a generally known manner. Air is exhausted from the interior space of the carriage 70 by a corresponding exhaust duct 53 which extends along the interior space near floor level. An electric powered exhaust blower 52 draws air from the interior space through the exhaust duct 53 and to the exterior, also underneath the carriage. Such a lay-out is generally known.

The exterior mouths of the intake and exhaust ducts are each provided with a ventilator control device 1 which is described in more detail with reference to FIGS. 2 to 6.

Figure 3:
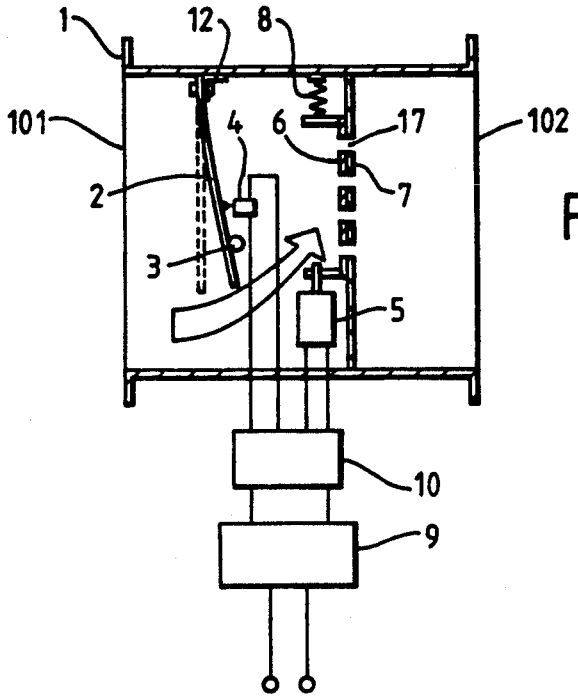
FIG. 3 is a section at A—A of FIG. 2 showing, partly schematically, the operation of the device.

Each control device is formed in a section of steel duct having a rectangular cross-section, mounted towards the exterior relative to the blower fan. The duct section has an upstream opening 101 and a downstream opening 102. Towards the upstream opening, a metal leaf spring 2 projects about three-quarters of the way across the duct, from a fixed mounting 12 at one side thereof. Leaf spring 2 is a rectangular sheet of springy steel e.g. cold-rolled stainless steel strip made for spring applications. It extends across most of the height of the duct, but only about three-quarters of the width (in its elongate direction). A stopping bar 3 and, by a bracket **4*b*, a limit switch unit 4 are fixed to the duct wall a short distance downstream of the leaf spring 2. A sufficient bending displacement of the leaf spring 2 (as seen in FIG. 3) causes it to contact a movable actuating element 4*a* of the limit switch unit so as to close the switch. This degree of movement also brings the leaf spring 2 up against the stopper 3** so that it cannot move further and damage itself or the switch.

Figure 4:
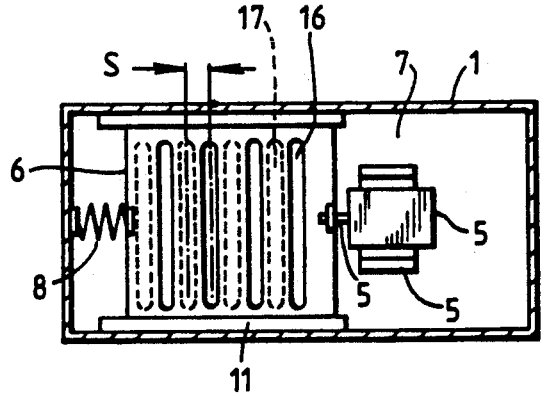
FIG. 4 is a section at B—B of FIG. 2, showing a shutter.
Figure 5:
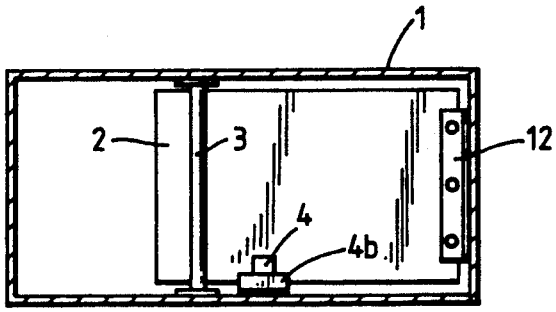
FIG. 5 is a section at C—C of FIG. 2, showing a leaf spring flap.
Figure 6:
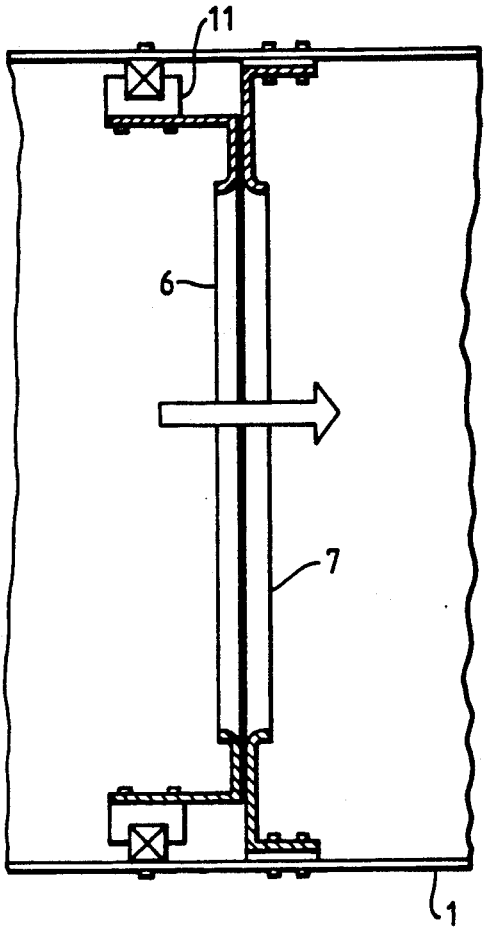
FIG. 6 is a section down the middle of FIG. 4, showing mounting of the shutter.

Further downstream, a shutter members 6,7 extends right across the duct. This consists of a fixed shutter wall 7 which occupies the entire duct area but towards one side of the duct has a series of ventilating apertures 17 forming a grille allowing ventilating air through. The other element is a movable shutter plate 6 which is superimposed over the grille area of the fixed plate 7, on the upstream side, and itself has apertures 16 forming a grille corresponding to that of the fixed plate. The two plates therefore co-operate to form a shutter of the "hit or miss" type in which only a small amount of movement of the shutter plate 6, corresponding to the pitch of the apertures, is needed to pass between the fully open and fully closed conditions. The apertures are parallel elongate ovals. The shutter plate 6 is mounted between linear bearing runners 11 at the top and bottom of the duct (see FIG. 6) to enable this movement, which is transverse to the general flow direction of the duct. A small laminar gap is left between the two plates 6,7 so that they do not make frictional contact. Where the two sets of apertures 16,17 are not aligned as seen in FIG. 4, scarcely any air can flow past the shutter. With the apertures 16,17 in alignment a substantial air flow is possible (indicated in FIG. 6).

A linear solenoid 5 is fixed relative to the duct by securing it to the fixed plate 7 via a bracket 5*b*. The moving shaft 5*a* of the solenoid 5 is fixed to a projecting lug on the shutter plate 6 so that the solenoid 5 when actuated drives the shutter to its closed position. A return spring 8 engages the shutter plate between the opposite side of the duct and another lug on the shutter plate 6, which returns the shutter to the open position when the solenoid 5 is not activated.

Figure 9:
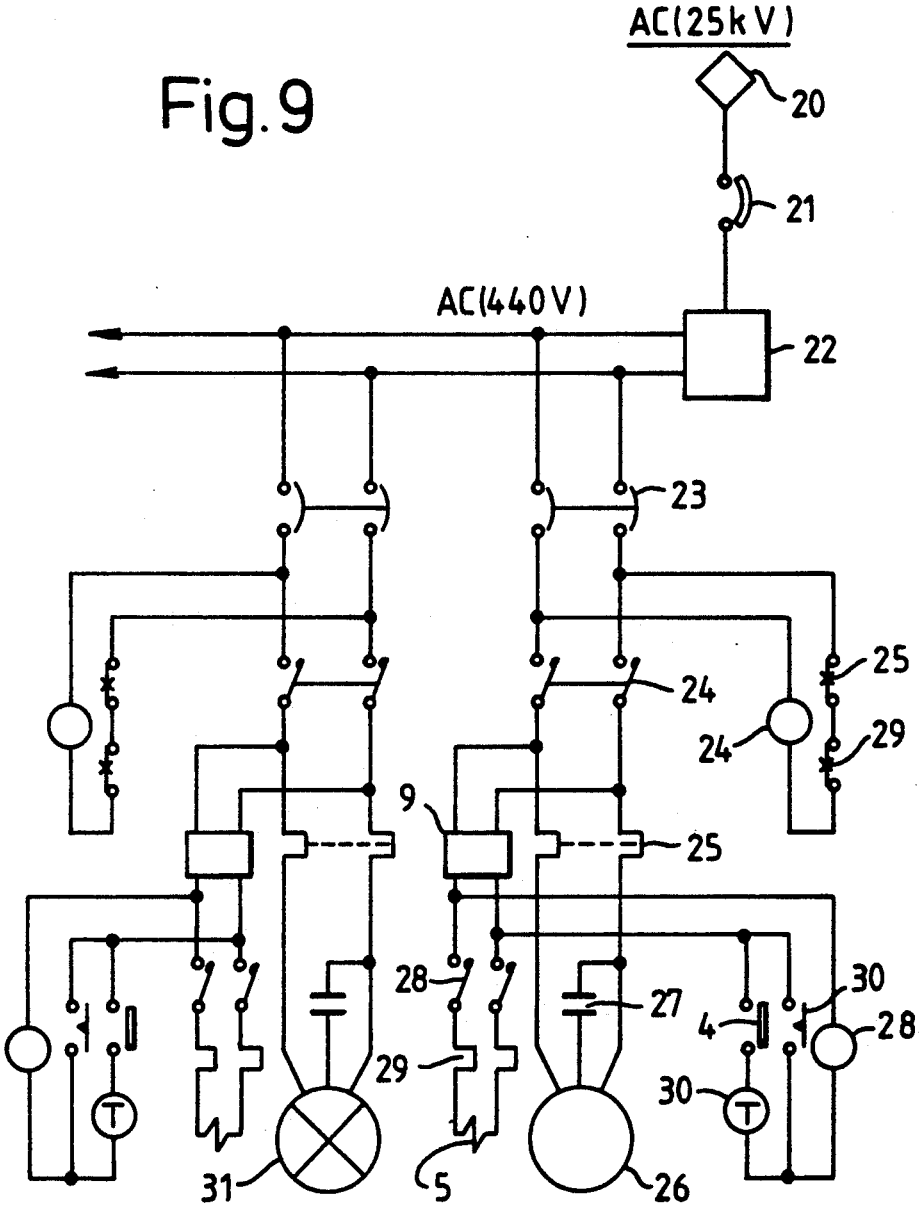
FIG. 9 is a system diagram for the ventilation system of one carriage.

Basic operational conditions for the device 1 are shown schematically in FIG. 3 and more comprehensively in FIG. 9. Medium voltage by AC power supplied primarily to the blower motors is diverted through a transformer 9, which transforms the medium voltage down to the specific voltage of the solenoid 5, passing thereto via a control board 10, which links the limit switch 4 and also has an electromagnetic contactor described later.

Briefly, the leaf spring 2 is deflected by air flowing through the ventilation duct, to corresponding to the air flow rate and determinable empirically. After a predetermined degree of deflection, as shown in FIG. 3, the rear surface of the leaf spring actuates the limit switch 4 which in turn activates the linear solenoid 5. The movable plate 6 is then immediately driven to close the shutter arrangement. Because only a very short stroke S is required to activate the limit switch 4 and linear solenoid 5, the operation is very quick.

Figure 7:
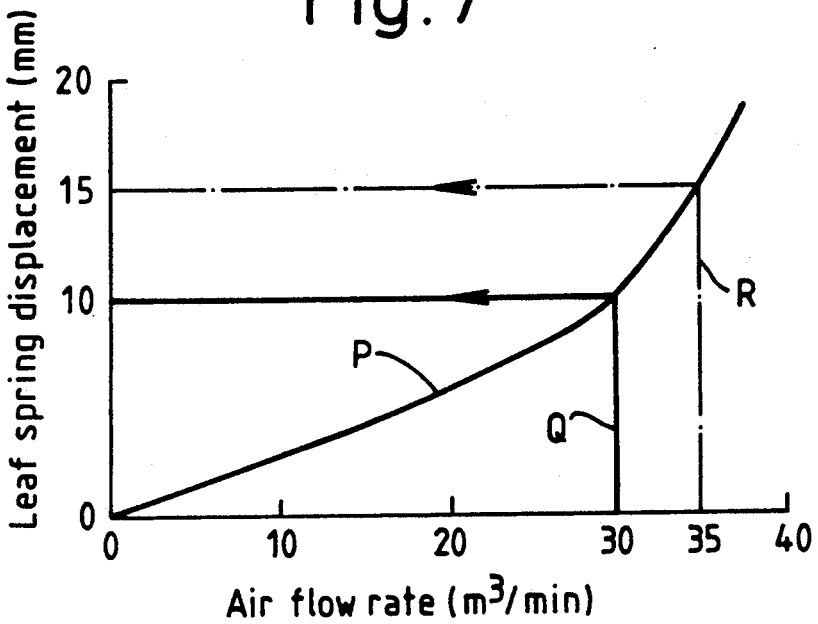
FIG. 7 illustrates a relationship between displacement of the leaf-spring flap and the flow rate through the device.
Figure 8:
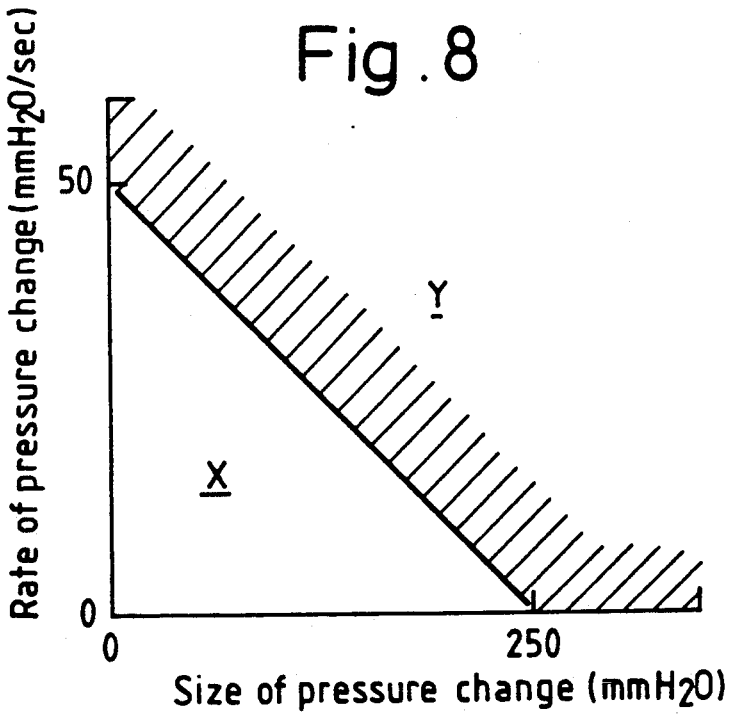
FIG. 8 shows a relationship between pressure conditions and passenger comfort in a carriage.

In FIG. 7, the curve P illustrates the characteristics of the leaf spring. Q indicates the rated flow rate for the ventilation system. R represents an excessive flow rate at which the ventilator should be shut off, to prevent pressure changes inside the car causing the "blocked ear" phenomenon. R can be determined from empirical studies, the results of which are represented in FIG. 8. FIG. 8 illustrates how either a very large pressure change or a very fast pressure change can cause the blocked ear feeling. Region X is a tolerable region; region Y is a region of discomfort while the line between them represents the onset of the blocked ear feeling. In this way, from FIG. 7, the leaf spring displacement corresponding to the shut-off air flow value R can be determined, and the limit switch is placed accordingly. Of course, it is always possible to fix the limit switch and select the spring characteristic of the leaf spring instead.

FIG. 9 is a more detailed electric system diagram for the ventilation control of one carriage. The circuits for controlling the intake blower and the exhaust blower are the same. Electricity is collected from an aerial cable at AC25 kV using a pantograph 20 via a vacuum circuit breaker 21. A main transformer 22 reduces the voltage to AC440 V for powering the motors 26,31 of the intake and exhaust blowers. The motors are connected by way of circuit breakers 23 (for wiring) and also electromagnetic contactors 24 and thermal relays 25 that serve as excess current protection devices. Capacitors 27 are provided for starting the three-phase motors.

Power for the linear solenoid 5 is taken from the output side of the electromagnetic contactor 24. Further, a thermal relay 29 is provided for the solenoid 5 in order to detect defects therein, and is arranged to cut off the main electromagnetic contactor 24 in the event that a defect is detected. In this way, any defect results in power being cut off from both the solenoid 5 and also the electric blower concerned to so that the blowers do not operate, problems can be easily detected, and the damage minimized.

Furthermore, since each blower includes leaf spring 2, limit switch 4 and solenoid 5, any problems with these can be confined to one ventilator control unit only, and other control devices in other carriages need not be affected.

FIG. 9 also illustrates the limit switch 4 and the of the limit switch 4 with the electromagnetic contactor 28 which actives and deactivates the solenoid 5. The circuit further includes a timer 30 which keeps the solenoid 5 connected to power for a predetermined time period even when the limit switch 4 is no longer closed. The pre-set time period $T_1$ imposed by this timer 30 should normally be at least 5 seconds, more preferably at 10 to 25 seconds and most preferably at 15 to 20 seconds.

Operation of the ventilation device 1 is now illustrated with reference to some operational examples.

Firstly, the situation when the pressure outside the carriage rises to substantially more than that inside is considered. The air flow rate through the intake increases, and the air flow rate through the exhaust decreases. The rapidly rising air flow through the intake bends the leaf spring against the limit switch 4 and so immediately shuts the shutter 6 The intake flow rate therefore drops to zero and the leaf spring 2 returns to a rest position, opening the limit switch 4. However, the timer 30 maintains the shutter closed for the predetermined time period $T_1$. This period is relatively short, and the exhaust flow rate is small during this time period. Accordingly, the substantial cessation of ventilation does not continue for a sufficient period of time to cause significant contamination in the passenger space. More importantly, the immediate cut off of the potentially excessive intake air flow prevents the propagation of the high pressure into the car and hence prevents the possibility of discomfort to the passengers.

From this, it will be appreciated that even a single ventilation control device as described e.g. in the intake, can give an advantage. As discussed in the fuller example given below, it is normally desirable to provide such a device for both the intake and the exhaust.

Figure 10:
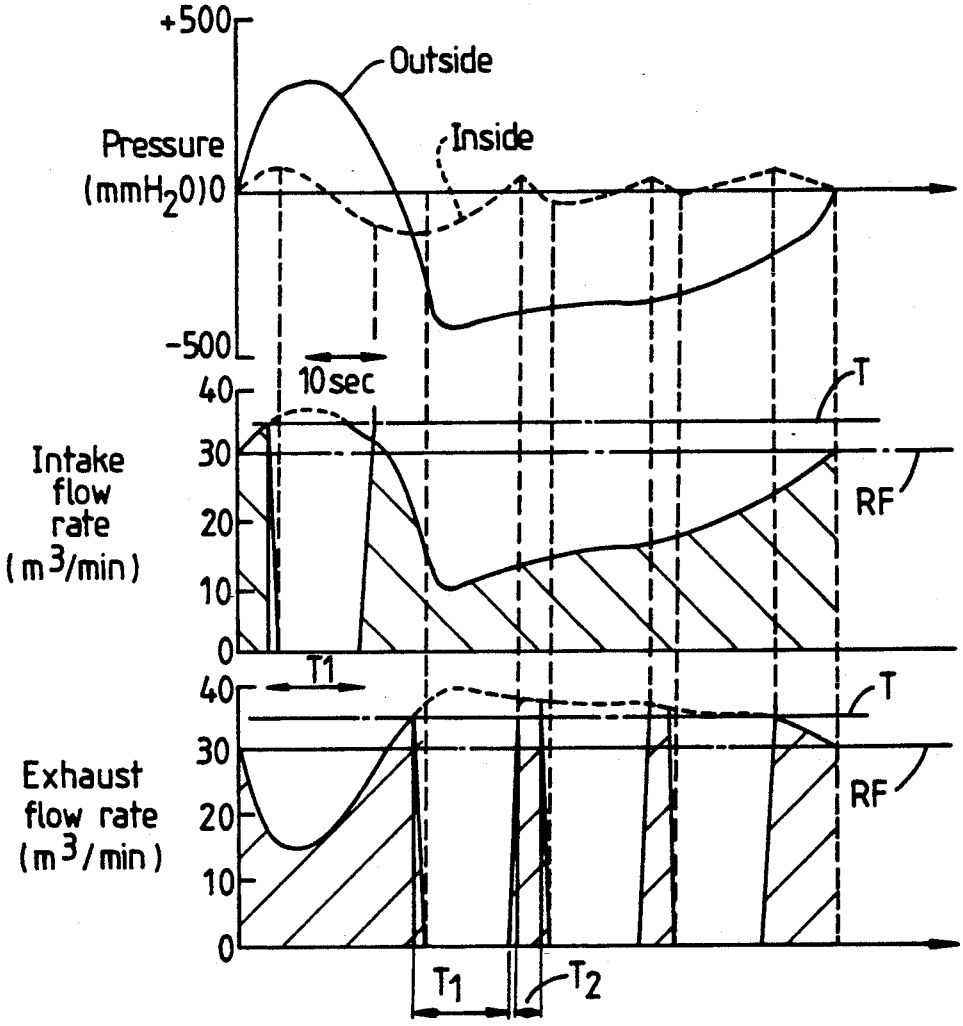
FIG. 10 shows the variation of pressure and ventilation parameters typical for the lead car of a train passing through a tunnel.

FIG. 10 illustrates three graphs having a common longitudinal time scale. The events are typical of those for the lead carriage of a train passing through a tunnel at very high speed e.g. about 300 km/h.

The top part of the FIG. 10 illustrates the pressure measured from outside the carriage, and calculated for the interior by simulation for the train passing through the tunnel. Initially, the relative pressure at the outside rises to a high value of about 300 $mmH_2O$ and then falls again, over a period of time exceeding 15 seconds. The exterior pressure then drops very steeply to a relative pressure below $-400$ $mmH_2O$. After that, it gradually returns to the normal level.

The middle and bottom parts of FIG. 10 illustrate the response of the ventilation control system. As the initial exterior to pressure rises, the intake flow rate rises steeply and within a few seconds meets the threshold value of 35 $m^3$/min. This triggers the limit switch 4 of the intake control device and the shutter 6 on the intake promptly closes the intake duct. As a result, the pressure inside the carriage rises by only a very small fraction of that outside. At this stage, the exhaust flow rate drops so that the exhaust duct is not closed, but the reduced flow rate prevents any excessive pressure fall inside the carriage.

Irrespective of outside pressure, the timer 30 of the intake device now holds the intake duct closed for the time period $T_1$: set to about 15 seconds in this case. The solenoid 5 is then released and the return spring 8 opens the shutter so that air flow resumes through the intake duct. By this time, the exterior pressure has been reduced, so the resulting intake flow is below the threshold level T although still just above the rated flow RF. Accordingly both ducts remain open.

The exterior pressure then drops steeply as described above. This causes a decrease in the intake flow rate, so the intake leaf spring does not actuate the shutter. The exhaust flow rate immediately and radiply increases because of the low outside pressure, and the exhaust flow rate rapidly rises to the threshold value T and closes the shutter of the exhaust duct for a time period $T_1$. In this case, the preset closure periods $T_1$ of the intake and exhaust devices are the same, although the time periods of the intake and exhaust device need not to be the same. After 15 seconds, the solenoid 5 is deactivated and the exhaust duct is re-opened. But, if the exterior pressure is still very low and the resulting flow rate through the exhaust is still above the threshold level. Very quickly, the leaf spring hits the limit switch 4 again and the exhaust duct is re-closed after a short time period $T_2$ for example 2 to 5 seconds corresponding to the time period necessary for the leaf spring 2 to operate. After another 15 seconds, the "sampling" is repeated: the exhaust duct is re-opened and flow resumed but if the flow rate is still too high for passenger comfort, the duct is promptly reclosed again.

By the next re-opening, however, if the exterior pressure is read normal, the exhaust flow rate drops below the threshold value T. The exhaust shutter therefore does not re-close, and ventilation continues as normal.

FIG. 10 illustrates how this operation keeps the pressure fluctuation inside the carriage relatively small, despite the very large and sudden fluctuations occurring outside. Conditions are maintained within regions "X" of FIG. 8, and the passengers do not feel discomfort.

Advantages of the system described will readily be perceived. Firstly, the co-operating relationship of the leaf spring, shutter and timer obviates any need for a purpose-made pressure sensor and processing circuitry for continuously monitoring the reading of the pressure sensor and the comparison of the read values with the reference threshold values. In the prior art, special low-voltage DC power sources were needed to run the sensor and control unit; with the present invention these are not needed. Instead, the leaf spring itself serves as a continuous sensor with a reference value built into its own physical construction and the spacing from the switch actuator 4*a*. The spring sensor 2 is robust, and unlike known sensing circuitry it is not liable to interference from electrical noise and the like. Using the pre-set timer feature, this simple sensor can "sample" the air flow conditions periodically while maintaining a sufficient degree of isolation of the passenger space.

The device described is also capable, unlike the prior art devices, of coping with the extreme pressure changes caused by extremely high-speed trains.

One of ordinary skill in the art would appreciate that other embodiments are possible.

Figure 11:
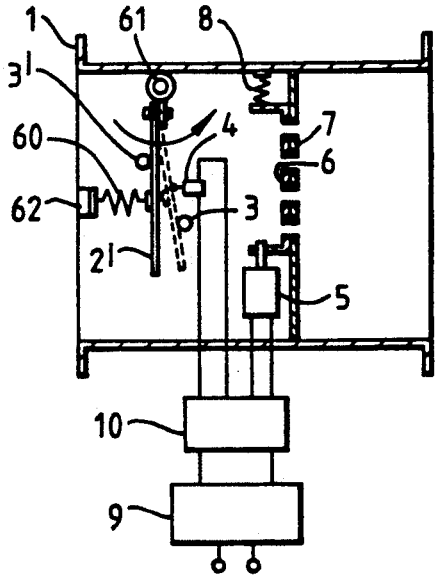
FIG. 11 shows a second embodiment of ventilation device in a view corresponding to FIG. 3.

For example, the leaf spring 2 is only one possibility for a flow sensing means. FIG. 11 illustrates another possibility, in which a rigid flap 2' is mounted at a pivot 61 at the side of the duct, and moved against the restoring force of a tension spring 60 connected to a lug 62 fixed to the duct upstream of the flap 2'. An extra stop member 3' is needed on the upstream side, to keep the flap perpendicular against the spring force.

In the embodiment specifically described, a duct was closed only if flow rate through that particular duct was sensed as excessive. In another embodiment, there can be synchronous operation whereby detection of an excessive flow rate in either the intake or the exhaust duct would trigger the shutting of both said ducts.

We claim:

1. A ventilation control device for a high-speed carriage, the ventilation control device comprising:

means for defining a ventilation duct through which a ventilation air flow can flow;

shutter means movable between an open position for enabling ventilation air to flow through the ventilation duct and a closed position for closing the ventilation duct;

means for moving the shutter means from the open position to the closed position;

movable air flow sensing means disposed in the ventilation duct for moving in response to ventilation air flow sensing the movement corresponding to the ventilation air flow in the ventilation duct, and initiating means connected to the shutter means for moving the shutter, said initiating means being responsive to the movement of the movable air flow sensing means, the initiating means moving said means for moving said shutter means to said closed position after the ventilation air flow exceeds a predetermined ventilation air flow.

2. A ventilation control device as claimed in claim 1, wherein the initiating means include an actuating member, and wherein the moveable air flow sensing means contacts said actuating member after said ventilation air flow exceeds the predetermined ventilation air flow.

3. A ventilation control device as claimed in claim 1, further comprising timer means for setting a motion time after an initiation of said driving means of said shutter means.

4. A ventilation control device as claimed in claim 1, wherein the movable air flow sensing means comprises a deflectable flap disposed in the ventilation duct.

5. A ventilation control device as claimed in claim 1, wherein the ventilation control device comprising further comprises blower means for driving the ventilation air flow through the ventilation duct.

6. A ventilation control device as for a high-speed carriage, the ventilation control device comprising:

means for defining a ventilation duct through which a ventilation air flow can flow;

shutter means movable between an open position for enabling ventilation air to flow through the ventilation duct and a closed position for closing the ventilation duct;

means for moving the shutter means from the open position to the closed position;

movable air flow sensing means disposed in the ventilation duct for moving in response to ventilation air flow sensing the movement corresponding to the ventilation air flow in the ventilation duct, comprising a deflectable flap disposed int he ventilation duct, said deflectable flap comprises a leaf spring; and initiating means connected to the shutter means for moving the shutter, said initiating means being responsive to the movement of the movable air flow sensing means, the initiating means moving said means for moving the shutter means to said closed position after the ventilation air flow exceeds a predetermined ventilation air flow.

7. A ventilation control device as claimed in claim 4, wherein the movable air flow sensing means further comprises a restoring spring engageable with the deflectable flap.

8. A train carriage having a ventilation system, said ventilation system comprising:

an intake duct for conducting ventilation air from an exterior of the train carriage to an interior of the train carriage;

an exhaust duct for conducting the ventilation air from the interior of the train carriage to the exterior of the train carriage;

an intake blower for blowing the ventilation air through the intake duct;

an exhaust blower for blowing the ventilation air through the exhaust duct;

intake air flow sensing means disposed in the intake duct for sensing the flow of the ventilation air, said intake air flow sensing means comprising means for determining when a flow of the ventilation air in the intake duct is equal to a first predetermined threshold value;

exhaust air flow sensing means disposed in the exhaust duct for sensing the flow of the ventilation air, said exhaust air flow sensing means comprising means for determining when the flow of the ventilation air in the exhaust duct is equal to a second predetermined threshold value;

an intake shutter operatively connected to the intake air flow sensing means and responsive thereto to close off the intake duct when the flow of the ventilation air is equal to the first predetermined threshold value, and an exhaust shutter operatively connected to the exhaust air flow sensing means and responsive thereto to close off the exhaust duct when the flow of the ventilation air is equal to the second predetermined threshold value.

9. A train carriage as claimed in claim 8, wherein the intake shutter, the exhaust shutter, the intake air flow sensing means and the exhaust air flow sensing means are exclusively supplied with AC electric power.

10. A train carriage as claimed in claim 8 further comprising:

electrically operated shutter drive means for moving the intake shutter and the exhaust shutter, and protection means for detecting a defect in the electrically operated shutter drive means and for cutting off the supply of electric power to the electrically operated shutter drive means, the intake blower and the exhaust blower when the defect is detected.

11. A train carriage as claimed in claim 8, wherein each of the intake air flow sensing means and exhaust air flow sensing means comprises a movable member movable by the flow of the ventilation air respectively disposed in the intake duct and the exhaust duct, and wherein a switching member is switched by the movable member only after the movable member has moved by a predetermined distance, to initiate an closing operation of one of the intake shutter and the exhaust shutter.

12. A train carriage as claimed in claim 11, wherein, after the movable member has moved the predetermined distance, the movable member mechanically contacts and switches the switching member.

13. A train carriage as claimed in claim 12, wherein the movable member comprises a flap, and wherein said flap extends across one of the input duct and the exhaust duct and is movable against a restoring force.

14. A method of ventilation a high-speed carriage, said high-speed carriage including a intake duct and an exhaust duct, each of said intake duct and said exhaust duct having a movable sensing member, the method comprising the steps of:

blowing air from an exterior of the high-speed carriage to a interior of the high-speed carriage through the intake duct;

blowing air from the interior of the high-speed carriage to the exterior of the high-speed carriage through the exhaust duct;

directing the blown air in the exhaust duct and in the intake duct against the movable sensing member of each of the intake duct and the exhaust duct respectively;

blocking one of the intake duct and exhaust duct when the movable sensing member moves a predetermined distance by placing one of the intake duct and the exhaust duct in a closed position;

holding one of the intake duct and the exhaust duct at the closed position for a predetermined time period, and re-opening one of the intake duct and the exhaust duct to allow resumption of air flow therein.

15. A method as claimed in claim 14, wherein the predetermined time period is at least 10 seconds.

16. A method as claimed in claim 14, wherein the high-speed carriage further includes a shutter for closing off one of the intake duct or the exhaust duct and the method further comprises the step of maintaining the shutter in a fully open position until the movable sensing member of one of the intake duct and the exhaust duct moves said predetermined distance.

17. A ventilating device for a high-speed train carriage comprising:

means for defining a ventilation duct;

a fan for blowing air through the ventilation duct;

a movable shutter to open and close the ventilation duct;

driving means for driving the movable shutter;

a movable flap, extending across the ventilation duct, and moved by an air flow through the ventilation duct against a restoring force, and means responsive to the movement of the movable flap for actuating the driving means to move the movable shutter to close the ventilation duct, after the movable flap has moved a predetermined amount.

18. A ventilating device as claimed in claim 17, wherein the movable flap is pivotaly mounted in the ventilation duct.

19. A ventilating device as claimed in claim 17, wherein the actuating means comprise a limit switch, located along a path of the movable flap, said limit switch contacting the movable flap after the movable flap has moved the predetermined amount.

20. An ventilating device for ventilating an interior of a high-speed carriage having a ventilating duct communicating between an interior and an exterior of the high-speed carriage, the ventilating device comprising;

a shutter adapted to open and close said ventilation duct;

a sensing device having a movable member moved by air flow between the interior of the high-speed carriage and the exterior of the high-speed carriage; and closure-initiating means actuated by the sensing device only after the movable member moves a predetermined amount, said closure-initiating means controlling the shutter to close the ventilating duct.

* * * * *